US009905336B2

(12) United States Patent
Gogola et al.

(10) Patent No.: US 9,905,336 B2
(45) Date of Patent: Feb. 27, 2018

(54) COATED STEEL WIRE AS ARMOURING WIRE FOR POWER CABLE

(71) Applicant: NV BEKAERT SA, Zwevegem (BE)

(72) Inventors: Peter Gogola, Hurbanovo (SK); Luc Vankemmelbeke, Lovendegem (BE)

(73) Assignee: NV BEKAERT SA, Zwevegem (BE)

( * ) Notice: Subject to any disclaimer, the term of this patent is extended or adjusted under 35 U.S.C. 154(b) by 0 days.

(21) Appl. No.: 14/889,341

(22) PCT Filed: May 27, 2014

(86) PCT No.: PCT/EP2014/060963
§ 371 (c)(1),
(2) Date: Nov. 5, 2015

(87) PCT Pub. No.: WO2014/202356
PCT Pub. Date: Dec. 24, 2014

(65) Prior Publication Data

US 2016/0111184 A1 Apr. 21, 2016

(30) Foreign Application Priority Data

Jun. 19, 2013 (EP) ..... 13172588

(51) Int. Cl.

| | |
|---|---|
| ***H01B 7/00*** | (2006.01) |
| ***H01B 7/28*** | (2006.01) |
| ***H01B 7/14*** | (2006.01) |
| ***H01B 7/22*** | (2006.01) |
| ***H01B 1/02*** | (2006.01) |
| ***H01B 5/10*** | (2006.01) |
| ***H01B 9/02*** | (2006.01) |

(Continued)

(52) U.S. Cl.
CPC ..... *H01B 7/2806* (2013.01); *H01B 1/02* (2013.01); *H01B 5/104* (2013.01); *H01B 7/14* (2013.01); *H01B 7/22* (2013.01); *H01B 9/025* (2013.01); *B21C 37/045* (2013.01); *H01B 7/26* (2013.01)

(58) Field of Classification Search
USPC .... 174/102 R, 102 C, 103, 106 R, 107, 108, 174/110 R, 110 S, 113 R, 116
See application file for complete search history.

(56) References Cited

U.S. PATENT DOCUMENTS 1,697,541 A * 1/1929 Schurer ..... H01B 7/26 174/105 R
3,555,169 A * 1/1971 Miller ..... H01B 11/00 174/106 R (Continued)

FOREIGN PATENT DOCUMENTS

CN 201345245 Y * 11/2009 ..... H01B 7/22
CN 101950619 A 1/2011

(Continued)

OTHER PUBLICATIONS

International Search Report (ISR) dated Aug. 4, 2014, for PCT/EP2014/060963.

*Primary Examiner* — William H Mayo, III
(74) *Attorney, Agent, or Firm* — Bacon & Thomas, PLLC

(57) ABSTRACT

A steel wire as an armoring wire for a power cable for transmitting electrical power, where the steel wire has a steel core and a non-magnetic coating. The coating has a thickness in the range of 0.2 mm to 3.0 mm and selected from metals or alloys having a melting point below 700° C.

16 Claims, 2 Drawing Sheets

(51) Int. Cl.
*H01B 7/26* (2006.01)
*B21C 37/04* (2006.01)

(56) References Cited

U.S. PATENT DOCUMENTS

| | | | | | |
|---|---|---|---|---|---|
| 5,170,015 | A * | 12/1992 | Kudo | H01B 1/02 | 174/119 R |
| 7,119,283 | B1 * | 10/2006 | Varkey | H01B 7/2806 | 174/102 R |
| 7,228,627 | B1 * | 6/2007 | Yoshimura | H01B 5/104 | 174/108 |
| 7,402,753 | B2 | 7/2008 | Varkey et al. | | |
| 2002/0027012 | A1 | 3/2002 | Bonicel | | |
| 2007/0158095 | A1 * | 7/2007 | Sridhar | G01V 1/201 | 174/106 R |
| 2012/0024565 | A1 * | 2/2012 | Orini | H01B 7/14 | 174/106 R |
| 2012/0097419 | A1 * | 4/2012 | Varkey | H01B 7/046 | 174/106 R |
| 2013/0272906 | A1 * | 10/2013 | Head | E21B 17/206 | 417/410.1 |

FOREIGN PATENT DOCUMENTS

| | | | | |
|---|---|---|---|---|
| CN | 202258511 U * | 5/2012 | | H01B 7/14 |
| EP | 0077108 A1 | 4/1983 | | |
| WO | WO2010/117961 A1 * | 10/2010 | | H01B 11/06 |

* cited by examiner

COATED STEEL WIRE AS ARMOURING WIRE FOR POWER CABLE

The invention relates to a non-magnetic material coated steel wire and the use thereof, e.g. as armouring wire for a submarine power cable for transmitting electrical power.

BACKGROUND

Electricity is an essential part of modern life. Electric-power transmission is the bulk transfer of electrical energy, from generating power plants to electrical substations located near demand centres. Transmission lines mostly use high-voltage three-phase alternating current (AC). Electricity is transmitted at high voltages (110 kV or above) to reduce the energy lost in long-distance transmission. Power is usually transmitted through overhead power lines. Underground power transmission has a significantly higher cost and greater operational limitations but is sometimes used in urban areas or sensitive locations. Most recently, submarine power cables provide the possibility to supply power to small islands or offshore production platforms without their own electricity production. On the other hand, submarine power cables also provide the possibility to bring ashore electricity that was produced offshore (wind, wave, sea currents . . . ) to the mainland.

These power cables are normally steel wire armoured cables. A typical construction of steel wire armoured cable 10 is shown in FIG. 1. Conductor 12 is normally made of plain stranded copper. Insulation 14, such as made of cross-linked polyethylene (XLPE), has good water resistance and excellent insulating properties. Insulation 14 in cables ensures that conductors and other metal substances do not come into contact with each other. Bedding 16, such as made of polyvinyl chloride (PVC), is used to provide a protective boundary between inner and outer layers of the cable. Armour 18, such as made of steel wires, provides mechanical protection, especially provide protection against external impact. In addition, armouring wires 18 can relieve the tension during installation, and thus prevent copper conductors from elongating. Possible sheath 19, such as made of black PVC, holds all components of the cable together and provides additional protection from external stresses.

Since the application environment of these cables is humid or contains moisture, certain corrosion protection for these cables is desired, in particular for submarine cables whose application environment is very corrosive. Because the cable (core) heats up and the corrosion resistance in sea water of the most steel grades strongly degrades with raising temperature, the corrosion protection of the power cables becomes crucial. Therefore, stainless steel or galvanized steel wires are considered to be used as armouring wires in particular for submarine power cables. US patent application 2002/0027012 A1 provides a less expensive substitute solution, where applies a reinforcing wire made of composite steel having a steel core of a standard type covered in a layer of stainless steel.

On the other hand, considering the magnetic fields associated with high voltage submarine cable, CN patent application 101950619A discloses an armouring structure formed by arranging round copper wires and non-magnetic stainless steel wires in alternation. The hybrid armoured layer formed by arranging the round copper wires and the non-magnetic stainless steel wires at intervals one by one can reduce the magnetic losses when used for armouring the submarine cable. However, due to the application of two materials, the production process becomes complex and the fitting of the cable into e.g. sockets may create problems. Moreover, the use of copper makes this armouring structure quite expensive.

SUMMARY OF THE INVENTION

It is a main object of the present invention to provide an armouring or reinforcing wire suitable for high voltage electrical power cables, in particular in submarine environment.

It is another object of the present invention to provide a steel wire armouring structure to minimize the magnetic loss of the power cable and simultaneously have strong mechanical protection and excellent corrosion protection.

According to the invention, a steel wire is used as an armouring wire for a power cable for transmitting electrical power, wherein the steel wire has a steel core and a non-magnetic coating, said coating having a thickness in the range of 0.2 mm to 3.0 mm and selected from metals or alloys having a melting point below 700° C.

Herein, the thick non-magnetic coating may be formed by any available techniques. For instance, it may be formed by cladding. In the context of the present invention, the term "cladding" means the process of providing a coating around a steel core in the form of a strip, a foil or a tube and fixing this to the steel core by means of welding or drawing or via diffusion by means of heat treatment.

The application of the invention steel wires having non-magnetic thick coating on steel core as armouring wires for power cables effectively reduces the energy loss of the power cables due to the non-magnetic property of the thick coatings on steel wires. Simultaneously, steel used as the core of the wire guarantees the mechanical protection to the power cable.

The invention heavily coated steel wire is particularly suitable for tri-phase submarine power cable. In three-phase power cables, the sum of the individual currents flowing through the three conductors is under ideal circumstances equal to zero. This means that no specific current return conductor is needed. If for one reason or another, such as asymmetric power production or consumption, the sum is not perfectly zero, the return current cannot perfectly flow through the conventional steel wire armouring; the water blocking barrier which are usually made of lead or lead alloy, and sometimes copper or aluminium are used for this. According to the present invention, a thick metallic non-magnetic coating, such as aluminium or copper, may also be functioned as a return conductor.

On the other hand, even if the sum of the three phase currents is zero or close to zero, this does not necessarily apply to the magnetic field: seen from a large distance, such as 10 meter or more away from the cable, the magnetic fields of the three conductors do compensate each other, yielding a very low magnetic field radiation there. But as the armouring wire is normally applied quite close to the individual conductors, we have to take into account that the magnetic fields radiated by the three individual conductors are not fully compensating each other right there. This means that the fluctuating magnetic field strength in the armouring is quite high, which leads to important losses in the armouring: hysteresis losses and eddy current losses, whereby at 50 Hz hysteresis accounts for about 90% of the magnetic losses and eddy-currents for not more than 10%. At higher frequencies, eddy current losses gain importance with respect to hysteresis (at 400 Hz both components are more or less the same size, but 400 Hz is normally not used for power transmission). The non-magnetic thick coating on the armouring wire can interrupt or deviate magnetic field to certain extent and thus reduce the magnetic field strength in the armouring layer. Therefore, the armouring layer made by the non-magnetic material heavily coated steel wires according to the present invention may considerably eliminate hysteresis losses and reduce eddy-current losses, compared to traditional armouring layer.

A typical (AC, 150 kV, three phase) 50 km long power cable consumes about 1.5% of the energy transported through it. Most of the energy is lost in the core conductors, because of their ohmic resistance (power loss=resistance× current$^2$). The magnetic losses are typically between 15 and 30% of the total cable losses and can be significantly eliminated by the use of armouring wire having non-magnetic thick coating, as the hysteresis effect explained above is quite limited. FIG. 2 schematically shows the magnetic flux lines in the armouring layer of a high voltage tri-phase power cable 20. As shown in FIG. 2, the magnetic field generated by the conductor 22 pass through the armouring wire 24 and form magnetic flux lines. Thus, the magnetic loss occurs. According to the invention, a non-magnetic thick coating on the armouring wires will build up a barrier, in-between two armouring wires 24, to interrupt or deviate magnetic field to pass through. Therefore, the magnetic field will flow out and will be significantly decreased in the armouring layer. Result shows that the influence of thin coating on magnetic field, e.g. the hot-dipped zinc coating of the traditional galvanized carbon steel wire where coating thickness is about 50 μm, is hardly observed. In contrast, nearly 70% magnetic loss in the armouring layer is eliminated by the application of zinc cladding of a thickness of 500 μm on the carbon steel armouring wire.

The thickness of said non-magnetic coating is in the range of 0.2 to 3 mm, preferably in the range of 0.5 mm to 3.0 mm, more preferably in the range of 1.0 mm to 2.0 mm. For example, the thickness of said non-magnetic cladding is about 0.5, 0.6, 0.7, 0.8, 0.9, 1.0, 1.1, 1.2, 1.3, 1.4 or 1.5 mm.

Preferably, said non-magnetic coating having been drawn or welded on said steel core also has corrosion resistant property. The thickness of the coating is much bigger than the thickness of commonly used galvanized layer formed by hot dip. In this sense, the corrosion resistance of the armouring wire according to the present invention is better than the one of steel wires having hot dip formed corrosion resistant coating. The life time of the power cable substantially prolongs due to the protection of the thick coating.

The non-magnetic thick coating may be any material having non-magnetic properties. Metals or alloys having good corrosion resistance and low melting point, preferably below about 700° C. are applied as non-magnetic coating in the present invention. The materials having low melting point are easy to be applied by cladding. The welding zone of low melting point material due to cladding process is normally much smoother compared with high melting point material. Due to the low melting point of material, the adhesion of the coatings to steel wires is better. Moreover, the coatings of low melting point material are less sensitive to damage, e.g. during cabling. As a consequence, the coatings of low melting point material can provide better galvanic protection on potentially high damaged places. Importantly, as a non-magnetic coating the thickness of the coating from low melting point materials is quite uniform, especially from materials having a melting point below 700° C., such as zinc (melting point ~420° C.), aluminum (melting point ~660° C.), magnesium (melting point ~650° C.) and their alloys, such as zinc-aluminum alloy and zinc-aluminum-magnesium alloy. When such uniformly coated wires are applied as armouring wires for an electrical power cable, the magnetic loss or the elimination of the magnetic loss is not affected by the non-uniformity of the non-magnetic coating of the armouring wires.

Regarding stainless steel, it is known that only austenitic stainless steel is non-magnetic while ferritic and martensitic stainless steels are ferromagnetic. Therefore, austenitic stainless steel may be used as non-magnetic coating according to the present invention.

However, when the armouring wire used in power cables placed in a location, such as deep sea, where less oxygen is presented, preferably the non-magnetic coating is not stainless steel due to crevice and pitting corrosion. Stainless steel differs from carbon steel by the amount of chromium present. Unprotected carbon steel rusts readily when exposed to air and moisture. Stainless steels contain sufficient chromium (with a minimum of 10.5 wt %) to form a passive film of chromium-rich oxide, which prevents further surface corrosion and blocks corrosion from spreading into the metal's internal structure. Crevice corrosion usually occurs in gaps a few micro meters wide, in which circulation of the corrosive medium (electrolyte) is not possible. Operating conditions like crevices and stagnant sea water can accelerate the crevice and pitting corrosion of stainless steel. Once the steel gets affected, the dissolution sets in really fast, as re-passivation is almost impossible in this oxygen poor environment.

On the contrary, a thick coated corrosion resistant layer like zinc or zinc alloy on the steel offers an excellent resistance in the oxygen poor environment, making it more suitable for this specific application. Even when the zinc layer gets damaged, the surrounding zinc will act as a sacrificial anode and protect the underlying steel. The zinc coated steel wire may offer better corrosion protection in submarine environment than the classic hot dip galvanized carbon wires.

The steel core of said steel wire may be any standard steel. For example, it can be a low carbon steel in order to reach sufficient flexibility and remain low cost. Herein, 'low carbon' refer to the carbon content in the steel less than 0.4 wt %, preferably less than 0.2 wt %. Alternatively, high carbon steel may also be applied as a core in order to obtain high strength or better mechanical protection. Stainless steel, in particular austenitic stainless steel may be applied as a core to further reduce the magnetic loss. Alloying elements may be added in the steel depending on the demand.

Preferably said steel core according to the invention is a hard pre-drawn steel wire. A hard drawn steel wire has a much higher surface hardness than a wire rod just coming from the mill. Increased hardness of the inner core wire increases the adhesion of the coating to the steel core. A hard drawn steel also increases the initial tensile strength of the uncoated steel core wire. Further drawing the steel wire after coating increases even more the final tensile strength and improves the adhesion of the coating to the steel core.

The steel wire has a round cross-section and a diameter ranging between 1.0 mm to 10.0 mm including the thickness of coating. Preferably, the steel wire has a diameter of around 3, 4, 5, 6, 7 or 8 mm. The tensile strength of the armouring wire is preferably above 340 MPa, more preferably above 640 MPa.

A power cable using steel wires according to the present invention, wherein said steel wires are wound around at least part of said power cable. Preferably, the power cable has at least an annular armouring layer made of said steel wires. As an alternative solution, the power cable has at least an annular armouring layer made by arranging coated low carbon steel wires and coated austenitic stainless steel wires in any configuration. For instance, an annular armouring layer may be made by alternating coated low carbon steel wires and coated austenitic stainless steel wires, e.g. by alternating one cladded low carbon steel wires and one coated austenitic stainless steel wires, or by alternating two coated low carbon steel wires and one coated austenitic stainless steel wire.

According to the present invention, there is provided the use of the non-magnetic material heavily coated steel wire as an armouring wire for a power cable for transmitting electrical power. The power cable may be a tri-phase submarine power cable and have a high voltage of more than 110 kV.

However, the power cables, where the coated steel wires according to the invention are used as armouring wires, include high-voltage, medium-voltage as well as low-voltage cables. The common voltage levels used in medium to high voltage today, e.g. for in-field cabling of offshore wind farms, are 33 kV for in-field cabling and 150 kV for export cables. This may evolve towards 66 and 220 kV, respectively. The high-voltage power cables may also extend to 280, 320 or 380 kV if insulation technologies allow the construction. Since magnetic losses can also occur at low voltage levels, the invention armouring steel wires are also suitable for the low-voltage cables.

On the other hand, the power cables armoured with the invention steel wires can transmit electrical power having different frequencies. For instance, it may transmit the standard AC power transmission frequency, which is 50 Hz in Europe and 60 Hz in North and South America. Moreover, the power cable can also be applied in transmission systems that use 17 Hz, e.g. German railways, or still other frequencies.

BRIEF DESCRIPTION OF THE DRAWINGS

The invention will be better understood with reference to the detailed description when considered in conjunction with the non-limiting examples and the accompanying drawings, in which.

DETAILED DESCRIPTION OF THE INVENTION

Figure 1:
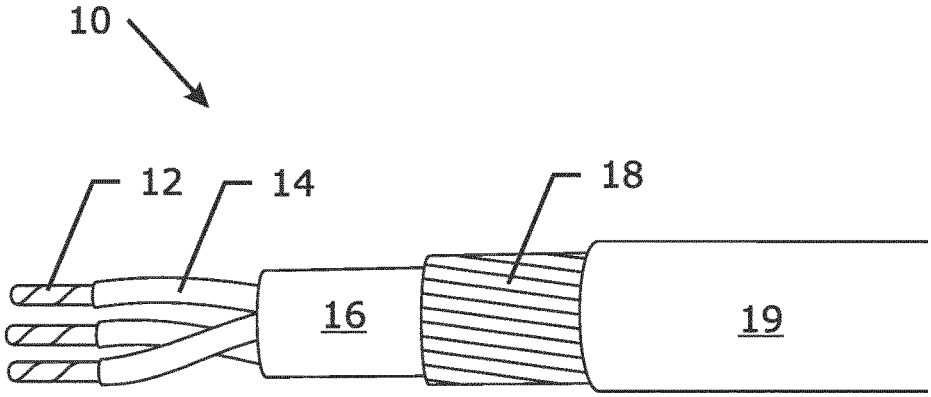
FIG. 1 is a high voltage power cable according to prior art.
Figure 2:
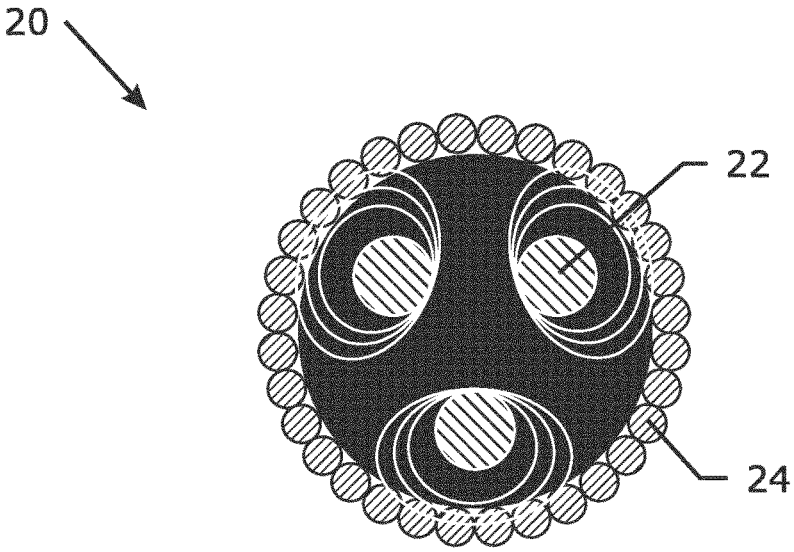
FIG. 2 schematically shows the magnetic flux lines in the armouring layer of a high voltage tri-phase power cable.
Figure 3:
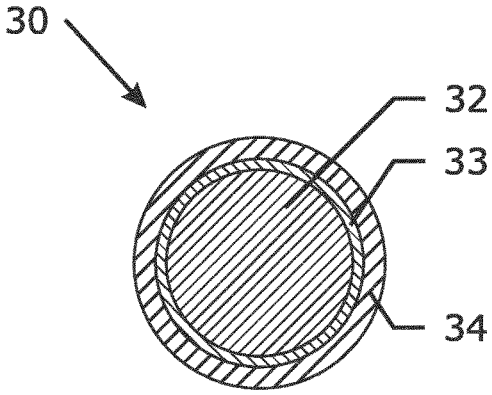
FIG. 3 is a cross-section of a cladded steel wire according to the present invention.

FIG. 3 is a cross-section of a cladded steel wire 30. Carbon steel wire 32 is covered by a non-magnetic corrosion resistant cladding 34. As an example, an intermediate layer 33, such as nickel or copper, may also be applied in-between the wire 32 and coating 34 to improve the adhesion.

A low carbon steel wire of a diameter of 5 mm is used as the core of the invention wire.

A low carbon steel grade is a steel grade where—possibly with exception for silicon and manganese—all the elements have a content of less than 0.50% by weight, e.g. less than 0.20% by weight, e.g. less than 0.10% by weight. E.g. silicon is present in amounts of maximum 1.0% by weight, e.g. maximum 0.50% by weight, e.g. 0.30% by weight or 0.15% by weight. E.g. manganese is present in amount of maximum 2.0% by weight, e.g. maximum 1.0% by weight, e.g. 0.50% by weight or 0.30% by weight. Preferably for the invention, the carbon content ranges up to 0.20% by weight, e.g. ranging up to 0.06% by weight. The minimum carbon content can be about 0.02% by weight. In a more preferred embodiment, the minimum carbon content can be about 0.01% by weight. The steel wire is processed continuously on one or more lines depending on the capabilities of the production site.

This steel wire is first degreased in a degreasing bath (containing phosphoric acid) at 30° C. to 80° C. for a few seconds. An ultrasonic generator is provided in the bath to assist the degreasing. Alternatively, the steel wire may be first degreased in an alkaline degreasing bath (containing NaOH) at 30° C. to 80° C. for a few seconds. Electrical assistance is applied in the bath to assist the degreasing.

The steel wire may be processed additionally in an acidic pickling bath at 30° C. to 60° C. to increase surface cleanness. HCl, $H_2SO_4$ or other acids may be used for this purpose. Preferably electrolytic assistance is applied.

A cladding process is provided wherein a metal coating of predefined composition and thickness is applied to the low carbon steel core wire.

A strip of suitable non-magnetic material, e.g. zinc or zinc alloy, and predetermined thickness, e.g. 0.5 mm or 1 mm, can be formed into e.g. a tube form. The width of this strip is somewhat greater or equal to the circumference of the steel core to be covered. The strip is closed in a tube and welded around or on a steel core. After welding, Turks heads press the metal coating to the steel core.

Preferably the process step of welding may be preceded or followed by a step of drawing the steel wire in order to provide a steel wire with increased hardness and tensile strength and improved adhesion with the cladding.

Preferably the process step of welding may be followed by a step of pressing the coating against the steel core by means of Turks heads at a minimum temperature of 200° C.

Alternatively or additionally, the process step of enclosing the steel core with a strip or foil of metal may be followed by a step of annealing the steel core with the non-magnetic cladding at a temperature, such as above 550° C., for a time period ranging from a few seconds to a few minutes.

Figure 4:
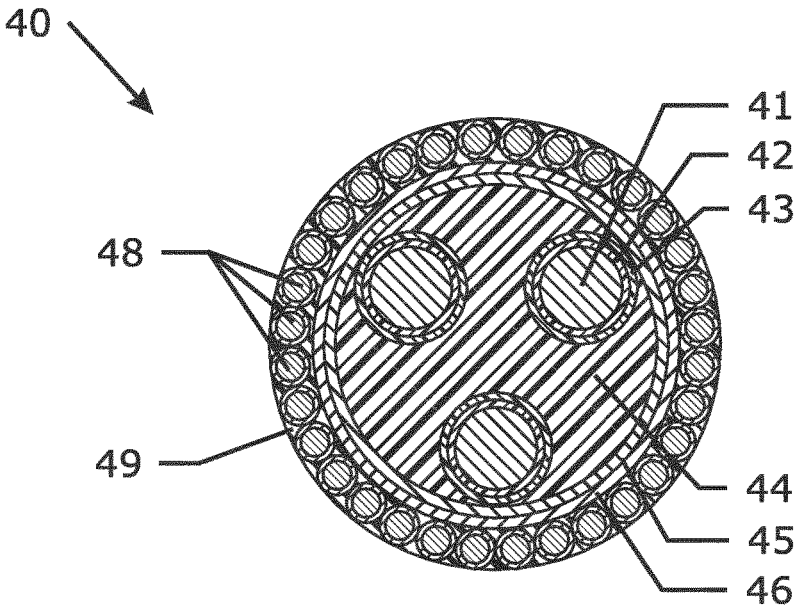
FIG. 4 is a cross-section of a tri-phase power cable having cladded armouring steel wires.

FIG. 4 represents a cross-section of a tri-phase submarine power cable armoured with the cladded steel wires according to the present invention.

The tri-phase submarine power cable 40 is shown in the illustration. It includes a compact stranded, bare copper conductor 41, followed by a semi-conducting conductor shield 42. An insulation shield 43 is applied to ensure that the conductor do not contact with each other. The insulated conductors are cabled together with fillers 44 by a binder tape, followed by a lead-alloy sheath 45. Due to the severe environmental demands placed on submarine cables, the lead-alloy sheath 45 is often needed because of its compressibility, flexibility and resistance to moisture and corrosion. The sheath 45 is usually covered by an outer layer 46 comprising a polyethylene (PE) or polyvinyl chloride (PVC) jacket. This construction is armoured by steel wire armouring layer 48. The steel wires used herein are according to the invention, i.e. they are non-magnetic and corrosion resistant material, e.g. zinc or zinc alloy, cladded steel wires. An outer sheath 49, such as made of PVC, cross-linked polyethylene (XLPE), a combination of PVC and XLPE layers, or bitumen is preferably applied outside the armouring layer 48.

Due to the application of a 0.5 mm zinc cladding on the steel armouring wire, the magnetic loss is eliminated by about 75%.

Figure 5:
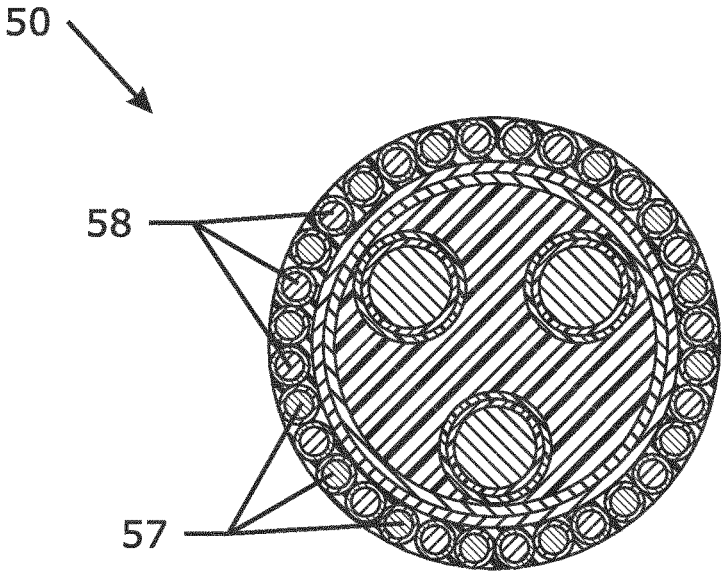
FIG. 5 is a cross-section of a tri-phase power cable having two types of cladded armouring wires in alternation.

FIG. 5 shows a cross-section of a tri-phase submarine power cable armoured with the cladded steel wires according to an alternative solution of the present invention. The armouring layer comprises two types of cladded steel wires 57, 58 in alternation. The steel core of one kind of armouring wire 57 is low carbon steel. The steel core of the other type of armouring wire 58 is austenitic stainless steel. The cladding for both types of armouring wires is zinc aluminium alloy and has a thickness of 0.5 mm. The magnetic loss for this alternative solution is eliminated by about 90%.

LIST OF REFERENCE NUMBERS

10 steel wire armoured cable
12 conductor
14 insulation
16 bedding
18 armour
19 sheath
20 power cable
22 conductor
24 armouring wire
30 cladded steel wire
32 steel core
33 intermediate layer
34 non-magnetic coating
40 power cable
41 copper conductor
42 semi-conducting conductor shield
43 insulation shield
44 fillers
45 lead-alloy sheath
46 outer layer
48 steel wire armouring layer
49 outer sheath
50 power cable
57 armouring wire with low carbon steel core
58 armouring wire with austenitic stainless steel core

The invention claimed is:

1. A power cable configured to transmit electrical power comprising at least a steel wire as an armouring wire, wherein the steel wire has a steel core and a non-magnetic coating, said coating having a thickness in the range of 0.5 mm to 3.0 mm and selected from metals or alloys having a melting point below 700° C., said non-magnetic coating configured to interrupt or deviate a magnetic field to pass through said steel wire, wherein said power cable comprises a plurality of said steel wires, and said steel wires are wound around at least part of said power cable.

2. The power cable as in claim 1, wherein said non-magnetic coating is corrosion resistant.

3. The power cable as in claim 1, wherein said non-magnetic coating is any one of zinc, aluminium, magnesium or their alloys.

4. The power cable as in claim 1, wherein said non-magnetic coating is formed by cladding.

5. The power cable as in claim 4, wherein said non-magnetic coating has been drawn or welded on said steel core, or via diffusion during a heat treatment on said steel core.

6. The power cable as in claim 1, wherein the thickness of said non-magnetic coating is in the range of 0.5 mm to 2.0 mm.

7. The power cable as in claim 1, wherein the thickness of said non-magnetic coating is in the range of 1.0 mm to 2.0 mm.

8. The power cable as in claim 1, wherein the steel core of said steel wire is low carbon steel.

9. The power cable as in claim 1, wherein said steel wire has a round cross-section and a diameter ranging between 1.0 mm to 10.0 mm.

10. The power cable as in claim 1, wherein said steel wire has a tensile strength above 340 MPa.

11. The power cable as in claim 1, wherein said power cable has at least an annular armouring layer made of said steel wires.

12. The power cable as in claim 1, wherein said power cable has at least an annular armouring layer made by alternating two types of coated steel wires, and one type of coated steel wire has low carbon steel core and the other type of coated steel wire has austenitic stainless steel core.

13. The power cable as in claim 1, wherein said power cable is a tri-phase submarine power cable.

14. The power cable as in claim 1, wherein said power cable is a high voltage cable of more than 110 kV.

15. The power cable as in claim 1, wherein said coating has a thickness in the range of 1.0 mm to 3.0 mm.

16. A power cable configured to transmit electrical power comprising at least a steel wire as an armouring wire, wherein the steel wire has a steel core and a non-magnetic coating, said coating having a thickness in the range of 0.5 mm to 3.0 mm and selected from metals or alloys having a melting point below 700° C., said non-magnetic coating configured to interrupt or deviate a magnetic field to pass through said steel wire, wherein said power cable comprises a plurality of said steel wires, and said steel wires are wound around at least part of said power cable, and wherein said non-magnetic coating comprises zinc or zinc alloy.

* * * * *